United States Patent [19]

Kataoka

[11] 4,428,574

[45] Jan. 31, 1984

[54] PAPER DELIVERY APPARATUS FOR USE IN ROTARY PRINTING PRESSES

[75] Inventor: Yoshitaka Kataoka, Toride, Japan

[73] Assignee: Komori Printing Machinery Co., Ltd., Tokyo, Japan

[21] Appl. No.: 307,853

[22] Filed: Oct. 2, 1981

[30] Foreign Application Priority Data

Nov. 29, 1980 [JP] Japan ..... 55-168444

[51] Int. Cl.[3] ..... B65H 29/40

[52] U.S. Cl. ..... 271/307; 271/178; 271/195; 271/211; 271/224

[58] Field of Search ..... 271/306, 307, 178, 211, 271/224, 221, 222, 195, 198, 214, 217

[56] References Cited

U.S. PATENT DOCUMENTS

| | | | |
|---|---|---|---|
| 3,166,313 | 1/1965 | Rehm | 271/178 |
| 3,224,761 | 12/1965 | Meyer-Jagenberg | 271/211 |
| 3,565,423 | 2/1971 | Kluth . | |
| 3,994,221 | 11/1976 | Littleton . | |
| 4,111,411 | 9/1978 | Graves . | |

FOREIGN PATENT DOCUMENTS

| | | | |
|---|---|---|---|
| 633818 | 2/1962 | Italy | 271/221 |
| 414690 | 12/1966 | Switzerland | 271/222 |

*Primary Examiner*—Richard A. Schacher

*Attorney, Agent, or Firm*—Thompson, Birch, Gauthier & Samuels

[57] ABSTRACT

In a paper delivery apparatus of the type wherein printed paper is cut into sections having a predetermined length and cut papers are delivered in the horizontal direction to be horizontally laminated on a pedestal, there are provided delivered paper guide belts with their lower runs running in a direction of paper delivery and a rotating brush roller provided at one end of the delivered paper guide belts. The rotating brush roller is implanted with a plurality of circumferentially spaced apart bristle bundles and rotated in a direction to press down the delivered paper onto the pedestal. According to this invention, it is not only possible to cause the papers to fall down while maintaining them at an horizontal attitude but also to eliminate curls formed at the ends of the delivered papers, thus neatly aligning the ends of the laminated papers.

2 Claims, 6 Drawing Figures

PAPER DELIVERY APPARATUS FOR USE IN ROTARY PRINTING PRESSES

BACKGROUND OF THE INVENTION

This invention relates to a paper delivery apparatus for delivering webs of paper printed by a rotary printing press after being cut but not folded. A rotary printing press utilized to print on a web of paper payed out from a roll of a paper feed device is usually provided with a folding machine that cuts the printed web to a predetermined length and then fold the cut length by a sheet delivery apparatus called a sheeter which cuts the printed web to a predetermined length and delivers the cut length as it is without folding the same. FIG. 1 diagrammatically shows paper delivery apparatus of the type described above. A printed web 1 set from a rotary printing press, not shown, is sent toward left while being clamped between a drag roller 2 and a paper clamping roller 3 and transferred by a plurality of transfer belts 4 and 5 opposing each other for clamping therebetween the printed web 1. Near the drag roller 2 is positioned a flying cutter 6 which cuts the web into sheets 7 (hereinafter merely termed a paper) having a predetermined length. The cut papers 7 are transferred further to the left by the belts 4 and 5 and an endless belt 8 contiguous to belts 4 and 5. The cut papers 7 are conveyed by a plurality of sets of paper delivery rollers 9 and 10 provided at the delivery end and an air nozzle 11 is provided to blast compressed air against the cut papers 7 so as to maintain them in a horizontal attitude. Consequently, the papers 7 fall down along a vertical guide 13 while mantaining their horizontal attitude to pile up on a paper supporting pedestal 14.

With this construction, however, the falling papers 7 are caused to flutter by the air jet ejected from the air nozzle 11. Especially, when the papers are thin, they flutter greatly so that neat piling becomes impossible. Moreover, since the papers 7 are delivered at a high speed when they collide against the vertical guide 13 their front ends tend to deflect upwardly or downwardly and the bent ends enter between the vertical guide 13 and a lower sheet of paper. To eliminate this difficulty it has been proposed to provide a shift and smooth board between a paper guide 12 near the delivery end and the vertical guide for guiding the papers along the board and then causing them to fall down smoothly. However, such board applies a braking force to the papers, thus preventing the same from reaching the vertical guide 13.

SUMMARY OF THE INVENTION

Accordingly, it is an object of this invention to provide an improved paper delivery apparatus for use in a rotary printing press that can neatly pile papers previously cut to uniform lengths.

Another object of this invention is to provide an improved paper delivery apparatus capable of eliminating end curls in the papers being delivered to the pile, thus enabling the papers to be piled with their ends neatly aligned.

Still another object of this invention is to provide paper delivery apparatus capable of conveying delivered papers without fluttering to a falling position and causing the papers to fall down upon a pedestal while maintaining the papers in a horizontal attitude.

According to this invention there is provided a paper delivery apparatus for use in a rotary printing press of the type wherein printed paper from the printing press is cut into a predetermined length and cut papers are successively delivered and horizontally piled on a pedestal, characterized in that there are provided delivered paper guide belts with their lower runs running in a direction of paper delivery, and a rotating brush roller provided at one ends of the delivered paper guide belts, the rotating brush roller being implanted with a plurality of circumferentially spaced apart bristle bundles and rotated in a direction to press down the delivered papers onto the pedestal.

DESCRIPTION OF THE PREFERRED EMBODIMENT

Figure 1:
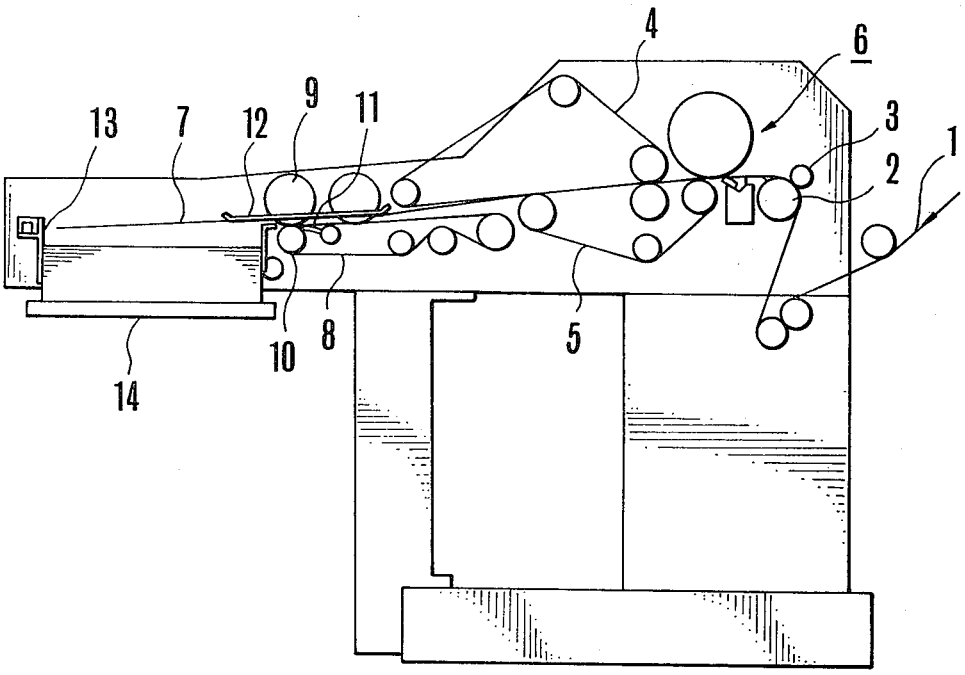
FIG. 1 PRIOR ART
FIG. 1 is a diagrammatic side view showing a prior art paper delivery apparatus utilized in combination with a rotary printing press.
Figure 2:
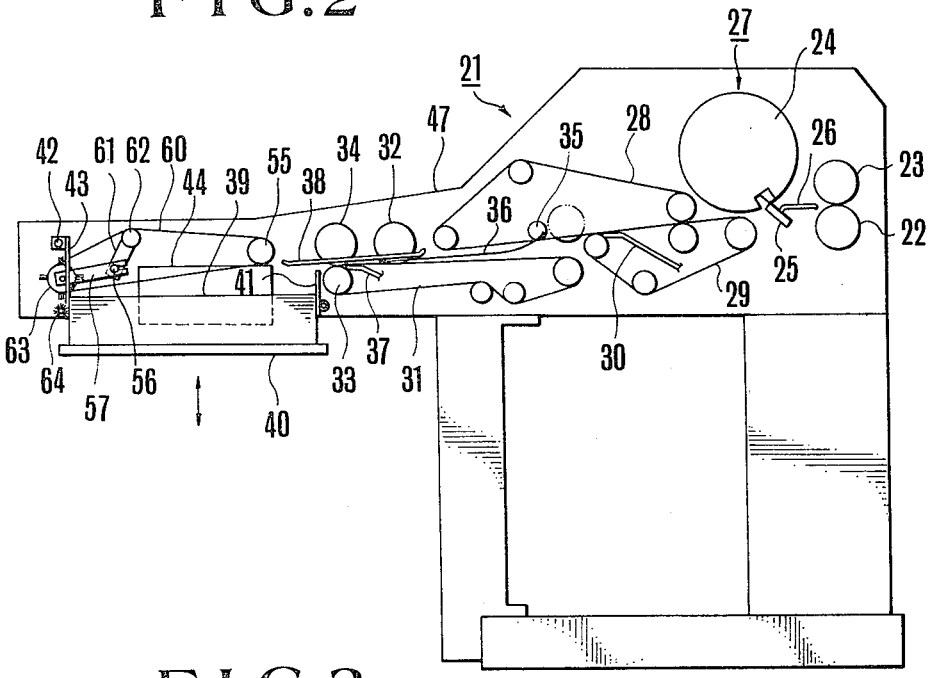
FIG. 2 is a diagrammatic side view showing one embodiment of the paper delivery apparatus according to this invention.
Figure 3:
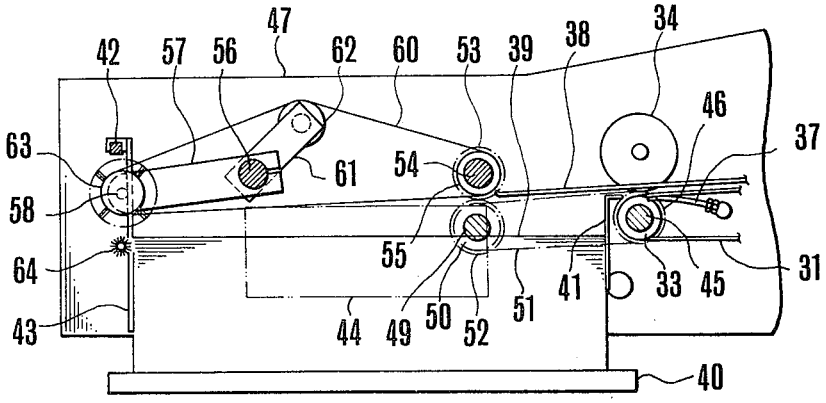
FIG. 3 is an enlarged side view of the paper delivery portion of the apparatus shown in FIG. 2.
Figure 4:
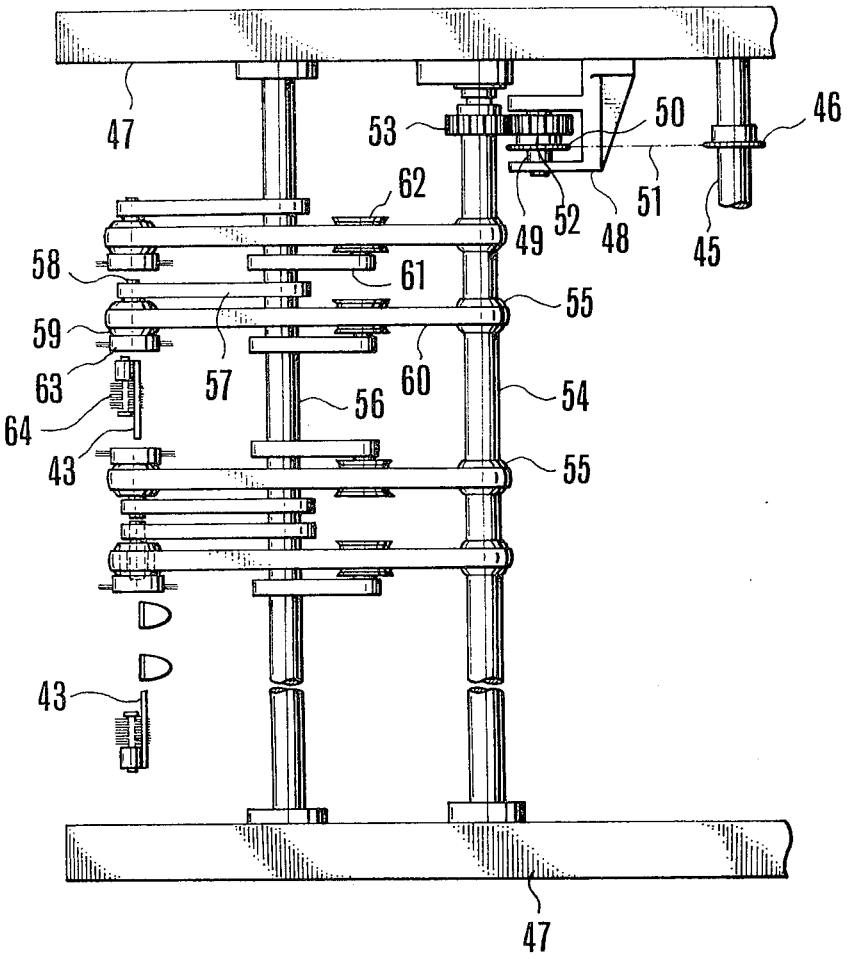
FIG. 4 is a plan view of the paper delivery portion shown in FIG. 3.
Figure 5:
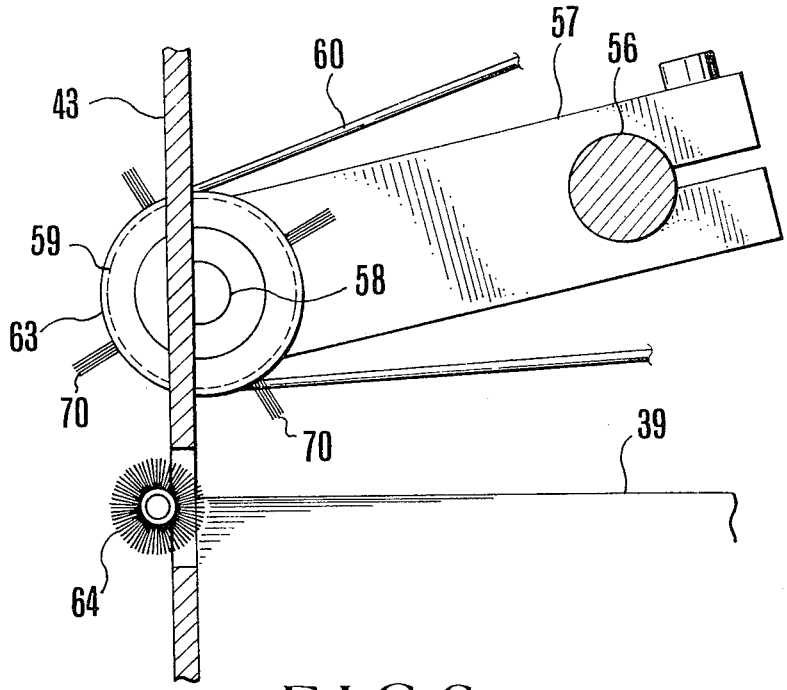
FIG. 5 is a side view showing rotating brush rollers.
Figure 6:
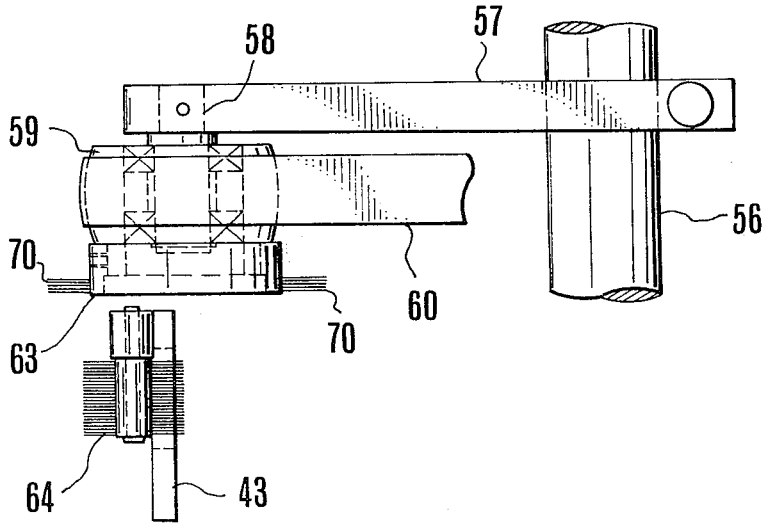
FIG. 6 is a plan view of the rotating brush rollers shown in FIG. 5.

As shown in FIGS. 2 to 6, the paper delivery apparatus 21 embodying the invention comprises a drag roller 22 and a paper clamping roller 23 which are positioned near the delivery end of a printing press, not shown, for clamping and transferring a printed paper web towards a cutting device 27. The cutting device includes a cylindrical flying cutter 24 having a single cutting blade and driven by a driving device, not shown, a blade receiver 25 and a paper guide 26. The paper delivery apparatus further comprises a plurality of continuous paper transfer belts 28 passed about a plurality of parallel rollers and a plurality of similar continuous paper transfer belts 29, the belts 28 and 29 being opposed to clamp cut papers therebetween. At the delivery ends of the lower paper transfer belts are provided a plurality of air nozzles 30 with their air ejecting ends opened between adjacent paper transfer belts 29. Further, in front of the lower paper transfer belts 29 are disposed a plurality of paper delivery belts 31 passed about a plurality of spaced parallel rollers, the upper runs of respective belts 31 being pressed downwardly by clamping rollers 32. Discharge rollers 34 are pressed against the rollers 33 via the paper transfer belts 31. Leaf springs 36 with their base portions supported by a stay 35 are urged against the upper surfaces of the paper transfer belts 31. A plurality of air ejecting nozzles 37 are disposed between adjacent rollers 34 with their ends opened between adjacent rollers 33. A plurality of elongated rectangular guide plates 38 are disposed adjacent discharge rollers 34 with their ends projected beyond the discharge rollers 34.

In front of the paper transfer unit is disposed a vertically movable elevator 40 on which papers 39 clamped between the discharge rollers 34 and the delivery belts 31 are sequentially piled. The elevator 40 is gradually lowered by an automatic elevating device as papers 39 are sequentially received thereon. Above the elevator 40 are provided a plurality of rear end align 41 which vertically alignes the rear ends of the papers 39 and an aligner 43 supported by a stay 42 and spaced from the aligner 41, the front ends of the papers 39 colliding with and being aligned against the aligner 43. Rectangular collecting plates 44 are provided on both sides of the papers 39 being piled on the elevator to align their side edges. A sprocket wheel 46 is secured to the shaft 45 of the roller 33 driven by a driving device, not shown, and a bracket 48 secured to side frames 47 in front of the roller shaft 45 supports an intermediate shaft 49 which supports a sprocket wheel 50. The roller shaft 45 and the intermediate shaft 49 are interconnected by a chain 51 passing about sprocket wheels 46 and 50. Above the intermediate shaft 49 is disposed a driving roller shaft 54 coupled with the intermediate shaft 49 through gears 52 and 53 and rotatably supported by both side frames 47. The shaft 54 supports a plurality of belt driving rollers 55. A shaft 56 extending in parallel with the roller driving shaft 54 between side frames 47 supports a plurality of forwardly projecting arms 57 for supporting shafts 58 rotatably carrying belt rollers 59. Delivered paper guide belts 60 pass about the rollers 55 and 59 with their lower runs facing the elevator 40 located thereunder running at the same speed as the paper delivery belt 31. The upper runs of the delivered paper guide belts 60 are tensioned by tension rollers 62 supported by arms 61 upwardly projecting from the shaft 56. Brush rollers 63 are integrally fitted onto four belt rollers 59 at the front ends of the delivered paper guide belts and located on both sides of the aligners 43. Several bundles of bristles are implanted into each brush roller 63 at four equidistant positions around the periphery thereof. The rollers 63 are rotated in the clockwise direction as viewed in FIG. 5 to press the delivered papers toward the the top of the pile 39. Brush rollers 64 are rotatably supported by two central aligners 43.

Numerous bristles are implanted in the brush rollers 64 around the entire peripheries thereof to form brushes which extend through perforations of the aligners 43 to the front ends of the papers being filed at 39.

The paper delivery apparatus 21 operates as follows. The printed papers sent from a printing press, not shown, are clamped between the drag roller 22 and the paper clamping roller 23 are then sent between upper and lower paper transfer belts 28 and 29 via the paper guide 26 to be transferred to the left as viewed in FIG. 2. Since the paper cutting drum 24 is designed to have the same peripheral length as the cut length of the printed paper, the printed paper is cut to have a predetermined length of each revolution of the cutting drum. The cut papers are clamped between upper and lower paper clamping belts 28 and 29 and the transferred papers are arrested by the leaf spring 36 and the paper delivering belts 31 before discharged from the belts 28 and 29 so that the papers are successively conveyed by the paper delivering belts 31 to be sent between the rollers 23 and the discharge rollers 34. Then the papers 39 are delivered along the lower surface of the guide plate 38 while being clamped between the belt rollers 33 and the discharge rollers 34 and blasted with compressed air ejected from the air nozzles 37. However, as the delivered paper guide belts 60 run in the direction of paper delivery, the papers are carried by the guide belts 60 while being blown up toward the belts. At the time when the front end of a paper collides against the front aligners the trailing end of the paper leaves the discharge rollers 34. Moreover the ejected air does not reach the trailing end so that the papers fall down while maintaining their horizontal attitude to pile up on the elevator 40.

As above described, since the delivered paper guide belts 60 are provided which run in the direction of delivery of the papers 39, the papers 39 blown up by the compressed air do not flutter nor are they frictionally braked. Accordingly they are conveyed along the guide belts in an extremely stable state. The guide belts 60 also prevent the papers from being blown off so that it is possible to increase the pressure of the ejected air which enables the delivery of papers in separated state, thus enabling to neatly align the paper ends without the fear of generating static electricity. The ends of falling papers often curl depending upon the quality of the papers and the type of the printing press. But as the rotating brush rollers 63 are provided in the falling path of the papers and rotated in the clockwise direction as viewed in FIG. 5 together with the belts 60, the bundles of the bristles sequentially engage curled ends of the papers to bring back them to the horizontal state, whereby the paper ends are neatly aligned one upon the other. When the falling papers are curled in the opposite direction the curled ends would tend to enter into a gap between the paper aligners 43 and the ends of the previously piled papers but as the brush rollers 64 are provided with the ends of their bristles slightly projected into the rear sides of the aligners 43 these projected ends straighten the curled ends also whereby the paper ends are neatly aligned one upon the other. As the papers are stabilized in the horizontal position, it is possible to increase the running speed of the machine. Experimental results show that it is possible to double the running speed when delivering thin papers. Further, it becomes possible to deliver much thinner papers than would be possible with the prior art machine.

As above described according to the paper delivery apparatus of this invention a delivered paper guide belt with its lower run running in the direction of the paper and a rotating brush roller are provided at the delivery end of the paper so as to convey the delivered paper blown up by compressed air along the delivered paper guide belt. Consequently, fluttering of the paper can be prevented. Moreover, the brush roller straightens the curled end of the paper so that it is possible to neatly align the ends of papers being piled. In this manner, as the papers fall down always in a stable horizontal attitude it is possible to increase the running speed of the apparatus. This is especially advantageous for thin papers.

What is claimed is:

1. For use in a printing press of the type wherein a printed paper web is subdivided by a cutter into sheets of a predetermined uniform length and the sheets are accumulated in a pile on a vertically adjustable elevator, the improvement comprising:

endless guide belts overlying said elevator and having their lower runs running in a sheet delivery direction;

means for receiving said sheets from said cutter and for conveying the same in said sheet delivery direction for discharge beneath the lower runs of said guide belts;

means for directing a flow of air upwardly towards the lower runs of said guide belts to urge said sheets into contact therewith, whereupon said sheets continue to be conveyed by the lower runs of said guide belts in said sheet delivery direction;

a vertical aligner at one side of said elevator, said aligner being positioned to be encountered by the leading edges of the sheets being conveyed by the lower runs of said guide belts and to thereby stop further movement of said sheets in said sheet delivery direction, the thus stopped sheets being thereafter free to drop towards said elevator;

a first brush roller having bristles arranged to contact the leading edges of the sheets being conveyed by the lower runs of said guide belts, said first brush roller being driven in a direction causing its bristles to eliminate upward curl of the leading edges; and a second freely rotatable brush roller having bristles arranged to contact and to eliminate and downward curl of the leading edges of sheets accumulating on said elevator.

2. The apparatus of claim 1 wherein a plurality of said first brush rollers are arranged on either side of said aligner, and wherein said second brush roller is supported by said aligner, with said aligner having an opening therein through which the bristles of said second brush roller extend.

* * * * *